US006470251B1

(12) United States Patent
Enix

(10) Patent No.: US 6,470,251 B1
(45) Date of Patent: Oct. 22, 2002

(54) LIGHT DETECTOR FOR MULTI-AXIS POSITION CONTROL

(75) Inventor: Bruce Wayne Enix, Huber Heights, OH (US)

(73) Assignee: Trimble Navigation Limited, Sunnyvale, CA (US)

( * ) Notice: Subject to any disclaimer, the term of this patent is extended or adjusted under 35 U.S.C. 154(b) by 0 days.

(21) Appl. No.: 09/653,430

(22) Filed: Aug. 31, 2000

(51) Int. Cl.[7] ..... E02F 3/76; G06F 7/00; G05B 19/18

(52) U.S. Cl. ..... 701/50; 356/138; 172/4.5; 37/382

(58) Field of Search ..... 701/50; 356/138, 356/3.16, 139.04, 152.1; 172/4.5, 12; 37/382, 907, 348, 381

(56) References Cited

U.S. PATENT DOCUMENTS

| | | | | | |
|---|---|---|---|---|---|
| 3,825,808 | A | * | 7/1974 | Teach | 318/266 |
| 4,162,708 | A | * | 7/1979 | Johnson | 172/4.5 |
| 4,273,196 | A | | 6/1981 | Etsusaki et al. | 172/4.5 |
| 4,413,684 | A | * | 11/1983 | Duncklee | 172/4.5 |
| 4,431,060 | A | * | 2/1984 | Scholl et al. | 172/4.5 |
| 4,537,259 | A | * | 8/1985 | Funabashi et al. | 172/4.5 |
| 4,807,131 | A | | 2/1989 | Clegg | 364/424.01 |
| 4,884,939 | A | | 12/1989 | Nielsen | 414/698 |
| 4,888,890 | A | * | 12/1989 | Studebaker et al. | 37/103 |
| 4,923,015 | A | | 5/1990 | Barsby et al. | 172/4.5 |
| 5,000,564 | A | * | 3/1991 | Ake | 356/1 |
| 5,039,249 | A | | 8/1991 | Hansen et al. | 172/4.5 |
| 5,288,167 | A | | 2/1994 | Gaffard et al. | 404/84.05 |
| 5,440,923 | A | | 8/1995 | Arnberg et al. | 73/146 |
| 5,506,588 | A | | 4/1996 | Diefes et al. | 342/357 |
| 5,621,531 | A | | 4/1997 | Van Andel et al. | 356/399 |
| 5,631,732 | A | | 5/1997 | Schrum, Jr. | 356/147 |
| 5,682,311 | A | | 10/1997 | Clark | 364/424.07 |
| 5,713,144 | A | | 2/1998 | Haraoka | 37/348 |
| 5,736,939 | A | | 4/1998 | Corcoran | 340/905 |
| 5,799,403 | A | | 9/1998 | Schrum | 33/290 |
| 5,815,411 | A | | 9/1998 | Ellenby et al. | 364/559 |
| 5,859,693 | A | | 1/1999 | Dunne et al. | 356/4.01 |
| 5,951,612 | A | | 9/1999 | Sahm | 701/50 |
| 6,112,145 | A | * | 8/2000 | Zachman | 701/50 |

* cited by examiner

*Primary Examiner*—Tan Nguyen
*Assistant Examiner*—Dalena Tran
(74) *Attorney, Agent, or Firm*—Killworth, Gottman, Hagan & Schaeff LLP

(57) ABSTRACT

An apparatus and method for controlling a hydraulically movable tool carried by a machine in order to maintain a selected horizontal orientation and a selected elevation relative to an external light reference. The apparatus is a control device, having a light detector, placed at a known location along a longitudinal axis of the tool and a single-axis gravity-based sensor. The gravity-based sensor is also provided within the housing of the control device to measure the horizontal orientation (side-to-side slope or pitch) of the longitudinal axis of the tool relative to true horizontal at the known location. Finally, with internal valve drivers, the control device individually controls the lift mechanism(s) of the hydraulically movable tool to maintain both a selected elevation and a selected horizontal orientation with only the signals provided by the light detector and the gravity-based sensor.

12 Claims, 4 Drawing Sheets

LIGHT DETECTOR FOR MULTI-AXIS POSITION CONTROL

BACKGROUND OF THE INVENTION

The present invention relates to a control device for controlling a hydraulically movable tool carried by a machine, and more specifically, to a control device having a light detector and a gravity-based sensor which controls a lift mechanism of a machine to maintain a selected horizontal orientation and elevation of a tool carried by the machine.

A Grade Control Receiver is a dedicated laser receiver that includes internal valve drivers capable of controlling PT, PWM, and Danfoss® hydraulic valves. Grade Control Receivers are commonly used in construction and agriculture applications for controlling the horizontal orientation (slope and pitch) and elevation of a wide-range of industrial tools, such as trowels, blades, 3-point hitches, and screeds. For these applications, the prior art practice has been to use at least a pair of laser receivers in order to determine the orientation and elevation of hydraulically controlled ends of a tool carried by a machine. For example, U.S. Pat. No. 5,951,612 to Sahm discloses using a pair of laser receivers to determine the slope, pitch, and elevation of an implement on an earthmoving machine. U.S. Pat. No. 4,807,131 to Clegg discloses a system using two laser receivers mounted at the opposite ends of an earthmoving blade, wherein the control system measures the side to side slope of the blade by determining the difference in elevation of the two laser receivers.

While the above-mentioned arrangements provide effective ways to control the movement of a tool carried by a machine, the drawback of these prior art arrangements is the significant cost associated with using a plurality of laser receivers. This is particularly true with fairly inexpensive tool attachments, such as for a skid steer loader, in which the tool attachment may only be half as expensive as the pair of laser receivers. In most of the construction and agricultural applications for which these tool attachments are used typically only either the pitch or the slope is controlled, while the elevation is maintained in reference to an external light reference, such as a laser transmitter.

Therefore, there is a need for providing an economical control system which controls a hydraulically movable tool carried by a machine to maintain a selected horizontal orientation and elevation.

SUMMARY OF THE INVENTION

This need is met by an apparatus and method according to the present invention that automatically controls a hydraulically movable tool carried by a machine in order to maintain a selected horizontal orientation and elevation. The control device of the present invention comprises an integral light detector, an integral gravity-based sensor, and a computer. The control device is mounted at a known location along a longitudinal axis of the tool. The computer of the control device receives an elevation signal from the light detector indicating the relationship of the control device at the known position to an external light reference. Additionally, the computer receives an angle of deflection signal from the gravity-based sensor, which indicates either the pitch or the side-to-side slope of the control device at the known location from true horizontal. With the distances between the control device and all points along the longitudinal axis of the tool being known to the computer, the computer calculates the elevation and horizontal orientation (pitch or slope) of all points along the longitudinal axis of the tool. Once these points are calculated, the control device automatically controls each hydraulic cylinder of the machine to maintain a selected horizontal orientation and elevation of the tool.

In one aspect, the present invention is an apparatus for automatically controlling a hydraulically movable tool carried by a machine in order to maintain a selected horizontal orientation and elevation relative to an external light reference. The apparatus comprises a housing, a light detector accommodated within the housing and capable of producing a signal in response to detecting the external light reference, and a gravity-based sensor. The gravity-based sensor is also accommodated within the housing and is capable of producing a signal indicative of a detected angle of deflection of the tool from true horizontal. The apparatus further comprises a computer accommodated within the housing and electrically coupled to the light detector and the gravity-based sensor. The computer is adapted to receive the signals from both the light detector and the gravity-based sensor and to control both the selected horizontal orientation and the elevation of the hydraulically movable tool based on the signals.

In another aspect, the present invention is a method for automatically controlling a hydraulically movable tool carried by a machine to maintain a selected horizontal orientation and a selected elevation relative to an external light reference. The method includes the steps of providing a control device at a known location along a longitudinal axis of the tool, and entering into the control device a desired horizontal orientation. Both an external signal from the external light reference, indicating actual height of the tool at the known location, and angle of deflection to true horizontal are sensed by the control device. The control device determines if the angle of deflection and the external signal match the desire horizontal orientation and the selected elevation, and then responsively controls the hydraulically movable tool carried by the machine to maintain the horizontal orientation and the selected elevation.

In another aspect, the present invention is a machine for operating with an external light reference, comprising a tool, a mast attached to the tool, and a control device having a housing. The housing of the control device accommodates a computer, a light detector, and a gravity-based sensor, and is attached to the mast. The computer is operably coupled to the light detector and the gravity-based sensor, and is configured to determine both an elevation of the tool relative to the external light reference, and a horizontal orientation of the tool relative to true horizontal based on signals received from the light detector and the gravity-based sensor.

Other objects, features and advantages will appear more fully in the course of the following discussion.

DETAILED DESCRIPTION OF THE INVENTION

Figure 1:
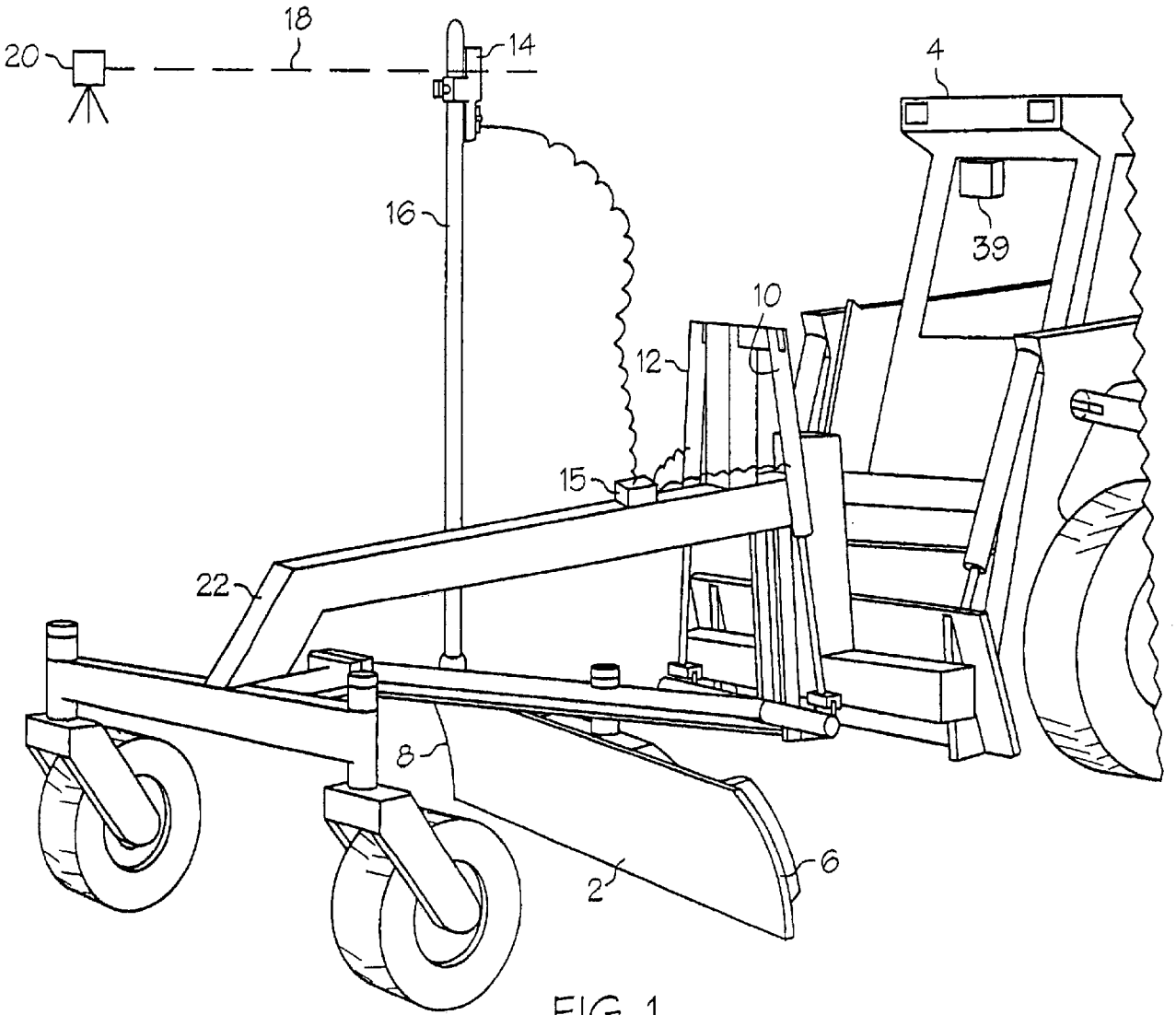
FIG. 1 illustrates a control device controlling a hydraulically movable tool carried by a machine, according to the present invention.

FIG. 1, by example only, illustrates a method and apparatus for the automatic control of the elevation and horizontal orientation (slope or pitch) of a tool 2 carried by a machine 4. Opposed ends 6 and 8 of the tool 2 are elevated and orientated by hydraulic cylinders 10 and 12, respectively. In order to determine both the elevation and angle of deflection from true horizontal of the hydraulically controlled ends 6 and 8, a control device 14 of the present invention is mounted adjacent one of the opposed ends 6 or 8 of the tool 2 on a rigid mast 16. An external light reference 18, which indicates a preselected elevation for the tool 2 may be provided such as from, but not limited to, an external rotating laser 20. The control device 14 raises and lowers the ends 6 and 8 of the tool, interfaced through a junction box 15, to maintain the elevation of the control device 14 relative to the received reference plane 18, and to maintain the angle of deflection of the control unit 14 with respect to true horizontal. The angle of deflection of the control unit 14 is maintained at a pre-set side-to-side slope or pitch. Although the machine 4 shown in FIG. 1 is a skid steer loader 4 with a grader attachment 22, it should be appreciated by those skilled in the art that the present invention may by applied to other types of machines, such as screeders, bulldozers, tractors, and to other types of attachments, such as buckets, planars, tillers, and the like. Accordingly, the tool 2 is typically used to scrape or cut the surface of a work area, and thus can be orientated in a number of positions relative to the machine 4.

Figure 2:
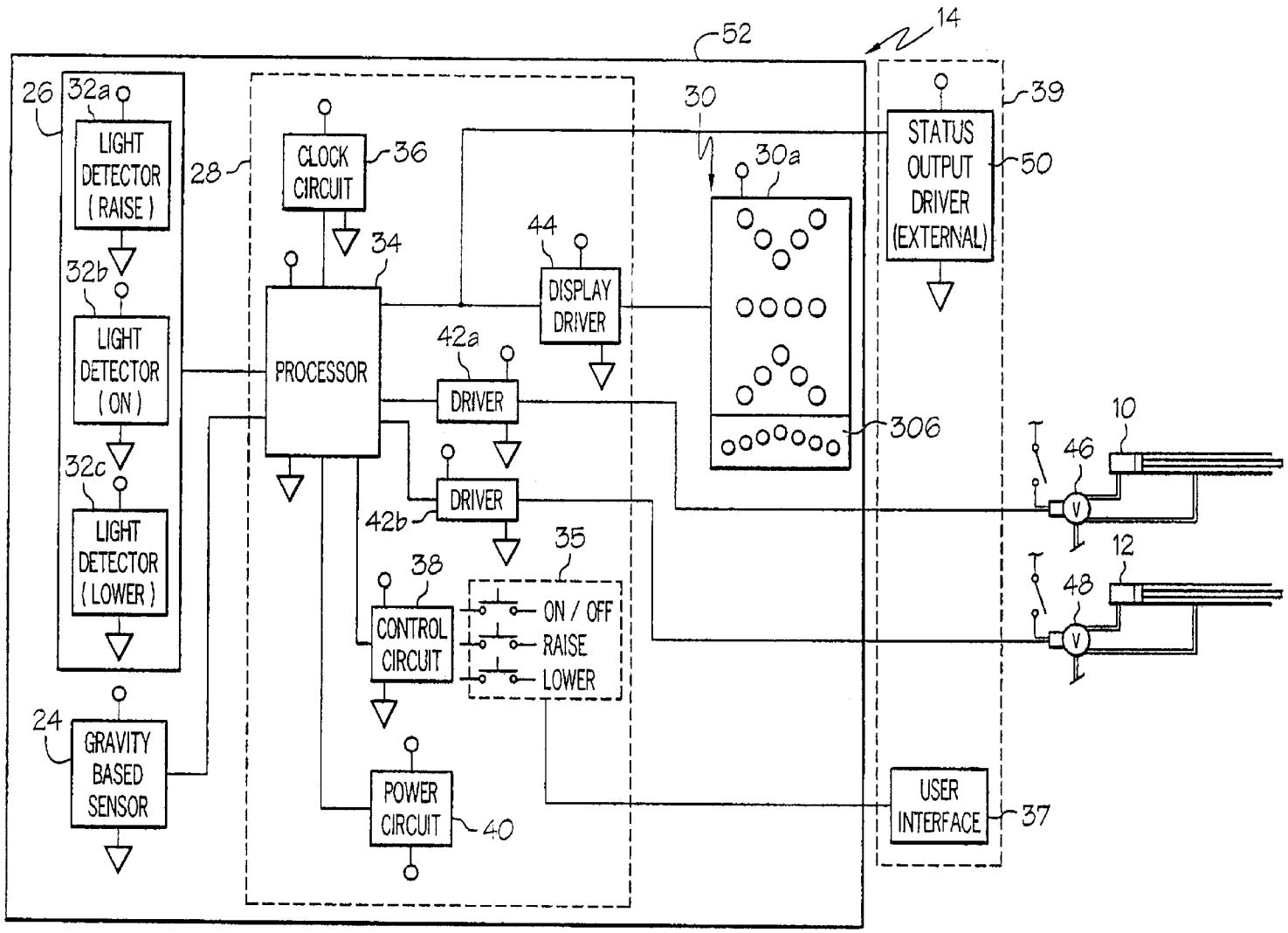
FIG. 2 illustrates a block diagram of the control device of FIG. 1, according to the present invention.

As shown by FIG. 2, in block diagram form, the control device 14 comprises a gravity based sensor 24, a light detector 26, a computer 28, and a display 30. The gravity-based sensor 24 produces a signal that is indicative of the sensor's angle of deflection from true horizontal in a measured axis. The gravity-based sensor 24 may be a single axis accelerometer or, alternatively, an inclinometer. One suitable accelerometer is the ADXL150 from Analog Devices, Norwood, Mass.; however, any accelerometer that is sensitive to accelerations in the measured axes may be used.

The light detector 26 includes, by way of example, a plurality of light receiving elements 32*a*–32*c* and as known, is used to determine elevation relative to the light reference beam. Beam 18 may be provided by a source of laser light 20 (FIG. 1). If the upper light receiving element 32*a* is actively receiving the light reference 18, the output signal from the light detector 26 indicates that the tool 2 (FIG. 1) is below grade, thus requiring raising in elevation. If the middle element 32*b* is actively receiving the light reference 18, the signal from the light detector 26 indicates that the tool 2 is on grade, thus requiring no correction in elevation. Finally, if the lower element 32*c* is actively receiving the light reference 18, the signal from the light detector 26 indicates that the tool 2 is above grade, and thus requires lowering in elevation. The plurality of light receiving elements 32 may be vertically aligned photoelectric cells in any desired number, or any other type of laser receiving device that detects an elevational position relative to a provided reference light. Although light detector 26 is common in the art, one suitable light detector is a model R25-S laser receiver from Spectra Precision, Inc.

The computer 28 may be, for example, a conventional digital processor such as is used in micro and minicomputers along with associated memory devices, e.g. ROM and RAM memory devices of any of a variety of types, power supplies, In and Out (I/O) circuitry, clocks, etc. as are well known in the digital processing arts. In particular, the computer 28 comprises a processor 34, circuit logic for a clock 36, circuit logic for user controls 38, and power management circuit 40, valve drivers 42*a* and 42*b*, and a display driver 44. The computer 28 is conventionally programmable, and is adapted to receive and to respond to signals from the gravity-based sensor 24 and light detector 26 to control both the elevation and the horizontal orientation of the tool 2. It is to be appreciated that the control device 14 may independently control either the elevation or the horizontal orientation of the tool 2, if desired.

The display 30 may be any of a variety of types, including, but not limited to, a monitor, a LED or LCD display, and the like. The display 30 is externally viewable and electrically connected to the computer 28. For example, the computer 28 may be configured to display the current elevation of the hydraulically movable tool based on the received signals of the light detector on an elevation display portion 30*a*, and the horizontal orientation (pitch or slope) based on the gravity-based sensor on an inclinometer display portion 30*b*.

The signals from the gravity-based sensor 24 and light detector 26 may be in any form, e.g. analog or digital, although digital signals are most easily accepted and processed without the need for digitizer circuits in the computer 28. The processor 34 is preferably a high performance RISC computer processing unit, such as a PIC16C73A processor from Microchip Technology Inc., Chandler, Ariz. The clock circuit 36 is conventional, and provides the necessary timing cycles for the processor 34, while the power management circuit 40 supplies the control device 14 with conditioned power and circuit breakers for surge protection. The control circuit 38 permits a user to turn the control device 14 on or off, to make value selection, to make calibrations, and to manually raise or lower each of the hydraulic cylinder 10 and 12, such as when desiring to bench the attached tool 2. It is to be appreciated that the control circuit 38 may be operated by a user at the control device 14, via an actuator group 35, or remotely via a user interface 37.

The computer 28 raises and lowers the hydraulic cylinders 10 and 12, via valve drives 42*a* and 42*b*, by controlling electrical valves 46 and 48 which operate associated hydraulic cylinders 10 and 12, respectively. It is to be appreciated that the valve drivers 42*a* and 42*b* of the computer 28 support industry standard PT, PWM, and Danfoss® valves, as well as, a load-sense valve. Additionally, if desired, the computer 28 may interface with an external status output driver 50 to provide information to a number of conventional external displays and indicators, such as those typically provided on a cab console 39, which may also house the user interface 37. Furthermore, it is to be appreciated that since the control device 14 may be carried on a machine involved in earth moving, the gravity based sensor 24, the light detector 26, and the computer 28 are shock mounted in a protective housing 52. The protective housing 52 also provides protection of the internal components from being damaged by exposure to the elements.

Figure 3:
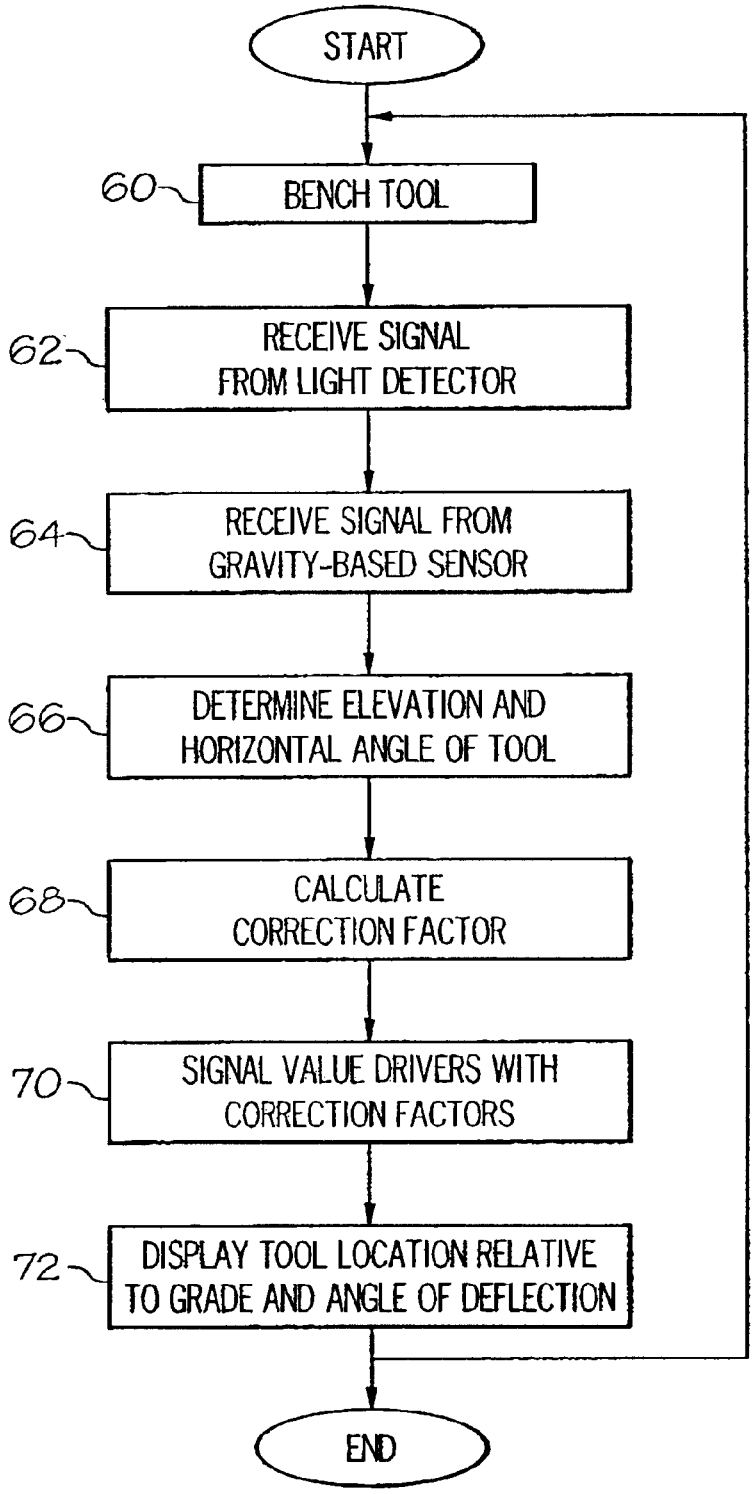
FIG. 3 is a flowchart illustrating a process of automatically controlling a hydraulically movable tool carried by a machine in order to maintain a selected angle of deflection from true horizontal and a selected elevation relative to an external light reference according to the present invention.
Figure 4:
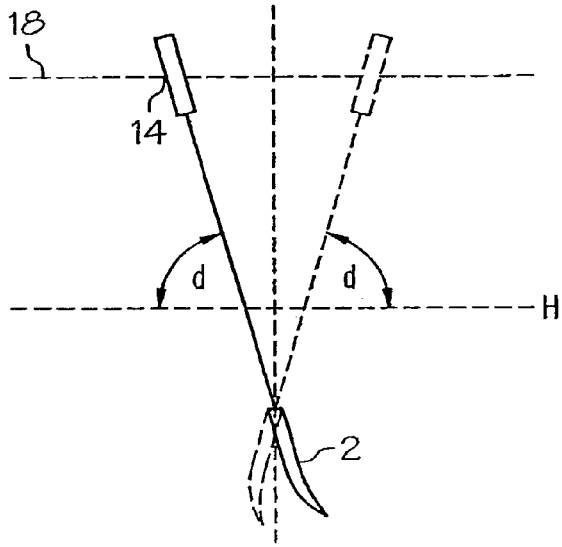
FIG. 4 is a diagrammatic representation of one aspect of the present invention viewed from another side.
Figure 5:
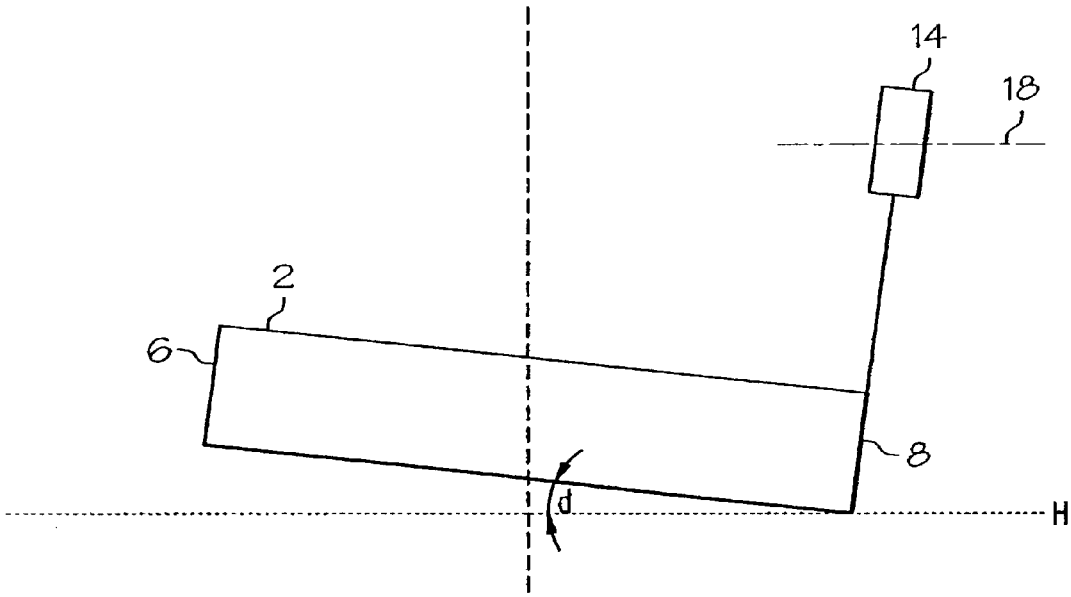
FIG. 5 is a diagrammatic representation of one aspect of the present invention as viewed from a side.

Turning now to FIGS. 3, 4, and 5, the method of automatically controlling a hydraulically movable tool carried by a machine in order to maintain a selected horizontal orientation (slope or pitch) and a selected elevation relative to an external light reference is discussed.

Referring to FIG. 3, in a first control block 60 the computer 28 is inputted with benching information or a set point regarding a desired horizontal orientation (slope or pitch). In a second control block 62 and a third control block 64 the computer 28 receives the signals from both the gravity-based sensor 24 and light detector 26. In control block 66, the signal from the light detector 26 is processed by the computer 28 to determine the necessary elevation correction, as previously explained above, in order to maintain the control unit on grade with the provided external light reference 18. Additionally, in control block 66, the computer 28 determines an angle of deflection d of the tool 2 with the signal from the gravity-based sensor 24. As illustrated in FIG. 4, if the gravity-based sensor 24 is utilized to determine pitch, then the angle of deflection d of the tool 2 to true horizontal H is the provided signal. Accordingly, in control block 68 the detected angle of deflection d is compared to a desired pitch p, preset in control block 60 during benching, wherein a correction factor is calculated. Similarly, as illustrated in FIG. 5, if the gravity-based sensor 24 is utilized to determine side-to-side slope of the tool 2 to true horizontal H, then the detected angle of deflection d is compared in control block 68 to a side-to-side slope a, preset in control block 60 during benching, wherein a correction factor is calculated. With the correction factor calculated, in control block 70 the computer 28 will instruct the appropriate valve drivers 42*a* and/or 42*b* to activate the associated electrical valves 46 and/or 48, thereby controlling the hydraulic cylinders 10 and 12 at the ends 6 and 8 of the tool 2 to maintain both the selected elevation of the tool relative to the external light reference 18 (FIG. 1) and the selected or preset horizontal orientation of the tool 2. Finally, in control block 72, the computer 28, via the display driver 44, provides to the display 30 the elevation and horizontal orientation of the tool 2.

Having described the invention in detail and by reference to preferred embodiments thereof, it will be apparent that modifications and variations are possible without departing from the scope of the invention defined in the appended claims.

What is claimed is:

1. An apparatus for automatically controlling a hydraulically movable tool carried by a machine in order to maintain a selected horizontal orientation and an elevation to an external light reference, comprising:

a housing adapted to be mounted on the hydraulically movable tool;

a light detector accommodated within said housing and capable of producing a signal in response to detecting said external light reference;

a gravity-based sensor accommodated within said housing and capable of producing a signal indicative of a detected angle of deflection of said tool from true horizontal; and a computer accommodated within the housing and electrically coupled to said light detector and said gravity-based sensor, said computer being adapted to receive said signals from both said light detector and said gravity-based sensor and to responsively control both said selected horizontal orientation and said elevation of said hydraulically movable tool in response to said signals.

2. The apparatus, as set forth in claim 1, wherein said selected horizontal orientation is a side-to-side slope of said hydraulically movable tool.

3. The apparatus, as set forth in claim 1, wherein said selected horizontal orientation is a pitch of said hydraulically movable tool.

4. The apparatus, as set forth in claim 1, further including a viewable display accommodated within said housing and electrically connected to said computer, and in which said computer is configured to display on said viewable display information related to said elevation and said horizontal orientation of said hydraulically movable tool.

5. The apparatus, as set forth in claim 1, wherein said computer is configured to drive electrical hydraulic valves of said hydraulically movable tool.

6. A method for automatically controlling a hydraulically movable tool carried by a machine in order to maintain a selected horizontal orientation and a selected elevation to an external light reference, said method comprising:

providing a control device at a known location along a longitudinal axis of said tool;

entering into said control device a desired horizontal orientation;

detecting an external signal from the external light reference by said control device indicating actual height of said tool at said known location;

sensing gravity which relates to an angle of deflection of said tool to true horizontal by said control device at said known location;

determining by said control device computing if said angle of deflection and said external signal match said desire horizontal orientation and said selected elevation; and responsively controlling said hydraulically movable tool carried by said machine to maintain said desired horizontal orientation and said selected elevation.

7. The method, as set forth in claim 6, wherein said desired horizontal orientation is selected from the group consisting of pitch, and a side-to-side slope.

8. The method, as set forth in claim 6, further including the step of displaying said angle of deflection and said external signal.

9. A machine for operating with an external light reference, comprising a tool;

a mast attached to said tool;

a control device having a housing, said housing accommodating a computer, a light detector, and a gravity-based sensor, said control device is attached to said mast, wherein said computer is operably coupled to said light detector and said gravity-based sensor, and configured to determine based on signals received from said light detector and said gravity-based sensor both an elevation to said external light reference and a horizontal orientation to true horizontal of said tool.

10. The machine, as set forth in claim 9, wherein said horizontal orientation is side-to-side slope of said tool.

11. The machine, as set forth in claim 10, wherein said horizontal orientation is pitch of said tool.

12. A method for automatically controlling a hydraulically movable tool carried by a machine, comprising:

providing an external light reference at a selected elevation;

providing a control device at a known location along a longitudinal axis of said tool;

entering into said control device a desired horizontal orientation;

sensing with the control device said external light reference and an angle of deflection of said tool to true horizontal at said known location;

using said control device to compare said angle of deflection and said sensed external light reference to said desire horizontal orientation and said selected elevation, respectively; and using said control device to responsively controlling said hydraulically movable tool carried by said machine to maintain said desired horizontal orientation and said selected elevation.

* * * * *